US005400579A

United States Patent [19]

Thompson

[11] Patent Number: 5,400,579

[45] Date of Patent: Mar. 28, 1995

[54] APPARATUS AND METHOD FOR THE MANUFACTURE OF TELEPHONE CABLES

[75] Inventor: Walter Thompson, Toronto, Canada

[73] Assignee: Ceeco Machinery Manufacturing Ltd., Concord, Canada

[21] Appl. No.: 163,735

[22] Filed: Dec. 6, 1993

Related U.S. Application Data

[63] Continuation of Ser. No. 795,067, Nov. 20, 1991, abandoned.

[51] Int. Cl.[6] ..... D01H 7/02; D07B 3/02

[52] U.S. Cl. ..... 57/59; 57/64; 57/58.83

[58] Field of Search ..... 57/58.49, 58.52, 58.54, 57/58.83, 58.86, 59, 64, 62, 63; 254/374, 393

[56] References Cited

U.S. PATENT DOCUMENTS

| | | | |
|---|---|---|---|
| 1,436,312 | 11/1922 | Grondahl | 57/58.57 |
| 1,907,345 | 5/1933 | Cornish | 254/393 |
| 2,331,648 | 10/1943 | Berggren et al. | 57/58.57 |
| 2,956,391 | 10/1960 | Demmel et al. | 57/60 |
| 3,684,245 | 8/1972 | Marichev et al. | 254/393 |
| 3,828,538 | 8/1974 | Yoshida et al. | 57/58.54 |
| 4,262,479 | 4/1981 | Lenorak | 57/58.54 |
| 4,335,571 | 6/1982 | Tarantola | 57/58.52 |
| 4,375,875 | 3/1983 | Richardson | 57/58.52 X |
| 4,384,447 | 5/1983 | Faulstich | 57/58.52 |
| 4,498,281 | 2/1985 | Wraight | 57/58.34 |
| 4,550,558 | 11/1985 | Bouffard et al. | 57/59 X |
| 4,574,574 | 3/1986 | Knaak | 57/58.84 X |
| 4,590,754 | 5/1986 | Bouffard et al. | 57/58.55 |
| 4,642,979 | 2/1987 | Tomioka et al. | 57/58.86 X |
| 4,704,855 | 11/1987 | Yoshida et al. | 57/58.49 X |

FOREIGN PATENT DOCUMENTS

| | | |
|---|---|---|
| 997633 | 9/1976 | Canada . |
| 2130612 | 6/1984 | United Kingdom . |

*Primary Examiner*—Daniel P. Stodola
*Assistant Examiner*—William Stryjewski
*Attorney, Agent, or Firm*—Lackenbach, Siegel, Marzullo, Aronson & Greenspan

[57] ABSTRACT

A double twist machine uses a reel on which two or more wires have been wound. Guides are provided within the double twist machine for simultaneously guiding all of the wires and imparting two twists to the entire set as the wires proceed through the double twist machine to thereby produce a set of wires twisted about each other which are all simultaneously taken off a single bobbin or reel. The number of wires on each reel and the number of bobbins mounted within the machine may be varied to produce telephone cable twins, triplets, quads and the like. A take-up used in conjunction with a bank of such machines can produce a wide variety of telephone cables.

17 Claims, 4 Drawing Sheets

APPARATUS AND METHOD FOR THE MANUFACTURE OF TELEPHONE CABLES

This application is a continuation of application Ser. No. 07/795,067, filed Nov. 20, 1991, now abandoned.

BACKGROUND OF THE INVENTION

1. Field Of The Invention

The invention generally relates to an apparatus and method for the manufacture of telephone cables of the type including a single or a plurality of sets of twisted wires.

2. Description Of The Prior Art

Telephone cables of the type which include a plurality of pairs of twinned wires are conventionally manufactured in either two stages or in one stage.

In the case where the cables are manufactured in two stages, the twinned wires are firstly prepared by twisting the wires together by means of so-called "twinning" or "pairing" machines. The twinned wires are then made up into telephone cables by means of, for example, stationary take-ups, so-called rotating take-ups or drum twisting machines.

One form of twinning machine conventionally used for manufacturing twinned wires is the double twist twinning machine. This machine includes a bobbin cradle around which is arranged a rotatable frame or bow which is driven to turn around the cradle. Wires to be twinned may be either supplied from bobbins on the bobbin cradle inside the twinning cage and taken up on a take-up reel outside the twinning cage. The aforementioned arrangement is sometimes referred to as a "inside-out machine". The wires to be twinned may also be supplied from outside of the twinning cage and taken up on a bobbin arranged within the bobbin cradle. The latter configuration is sometimes referred to as an "outside-in machine".

Outside-in machines are generally preferred in single twinners since the wires may be supplied from storage facilities of simple construction and greater capacity. In this case, the bobbin cradle within the twinning cage is also required to hold only a single bobbin. The "outside-in" machine is also readily adaptable for use with a greater number of wires.

If telephone cables are made in one stage, the apparatus involved comprises a plurality of twinning machines of the "inside-out" type. The pairs so manufactured are directed to any type of take-up (e.g. stationary or rotating take ups, single or double twist machines, capstan or extrusion lines) for laying up twinned wires to form a telephone cable. This is done in one operation.

The plurality of double twist twinning machines can be arranged horizontally or vertically, depending on the preferred plant lay out. One typical example of such an installation is disclosed in Canadian Patent No. 997,633.

SUMMARY OF THE INVENTION

It is an object of the present invention to provide an apparatus for making telephone cables which does not have the disadvantages and limitations inherent in comparable prior art machines.

It is another object of the present invention to provide an apparatus of the type aforementioned which is simple in construction and inexpensive to manufacture.

It is still another object of the present invention to provide an apparatus of the type under discussion which allows the construction of smaller machines which occupy less space.

It is yet another object of the present invention to provide an apparatus for the manufacture of telephone cables which can operate at significantly higher speeds than comparable machines currently being used for making the same telephone cable products.

It is a further object of the present invention to provide an apparatus for making telephone cables which makes it possible to enhance or optimize the productivity of extrusion machines which extrude the wires to be formed into the telephone cables.

It is still a further object of the present invention to provide an apparatus for the manufacture of telephone cables which can significantly reduce the number of bobbins required by at least one half, thus providing lower capital costs and material handling expenses.

It is yet a further object of the present invention to provide an apparatus for making telephone cables which makes it possible to wind more than two wires on the same bobbin and produce, with the same machine, different telephone cables including triplets or quads (three wires or four wires twisted together).

It is an additional object of the present invention to provide an apparatus for making telephone cables which can utilize two or more bobbins at least one of which is provided with a set of at least two or more wires thus allowing additional flexibility in the number of wires that are twisted together with a minimal number of reels or bobbins.

It is still an additional object of the invention to provide a method for the efficient production of telephone cables.

It is yet an additional object of the invention to provide a versatile method which enables the production of a wide variety of twisted cables with the minimum number of reels or bobbins and, therefore, machines which occupy less space than comparable machines currently used to make the same cables.

In order to achieve the above objects, and others which will become apparent hereafter, an apparatus for making telephone cables with multi-wire reels in accordance with the present invention, comprises a frame and rotating means arranged for rotation about an axis relative to said frame. A cradle is mounted on said frame and dimensioned and configurated to be contained within an envelope defined by said rotating means and adapted to receive as few as a single reel mounted within said cradle and at least one reel of which is wound with a set of at least two wires which can be simultaneously unwound from the reel. Means is provided for maintaining the position of said cradle substantially fixed about said axis relative to said frame during rotation of said rotating means. Guide means simultaneously guides the set of at least two wires from said at least one reel on said stationary cradle to said rotating means and thereafter to said stationary frame thereby imparting at least one twist to the set of at least two wires unwound from the reel. The apparatus may be used with two or more wires on the reel or the apparatus can be designed to accommodate two or more reels at least one of which is provided with two or more wires which can be simultaneously unwound. Single and double twist machines can supply said twisting means used to practice the invention.

The method in accordance with the invention comprises the steps of simultaneously unwinding a set of at least two wires wound on as few as a single reel. The wires are all guided to a twisting station and imparted at least a single twist. In this manner, a set of twisted wires may be produced with the use of only one reel. The same process can be used to unwind wires from at least two reels in, for example, a double twist machine with at least one reel being provided with a set of at least two wires. The method may involve using reels which have been previously wound with a set of at least two wires or the method may include the step of first winding a set of at least two wires on a reel, and loading the reel into the twisting machine for twinning. For more complex cables, the steps of the method are repeated in each of the twisting machines of a bank of twisting machines arranged in tandem to each other. The method further comprises the step of taking up the twisted wires from all of the twisting machines at a point downstream from all such machines to form a composite cable.

BRIEF DESCRIPTION OF THE DRAWINGS

Other aspects, objects and advantages of the present invention will become apparent upon reading of the following detailed description of a preferred embodiment of the present invention when taken in conjunction with the drawings, as follows.

DETAILED DESCRIPTION OF THE PREFERRED EMBODIMENTS

Figure 1:
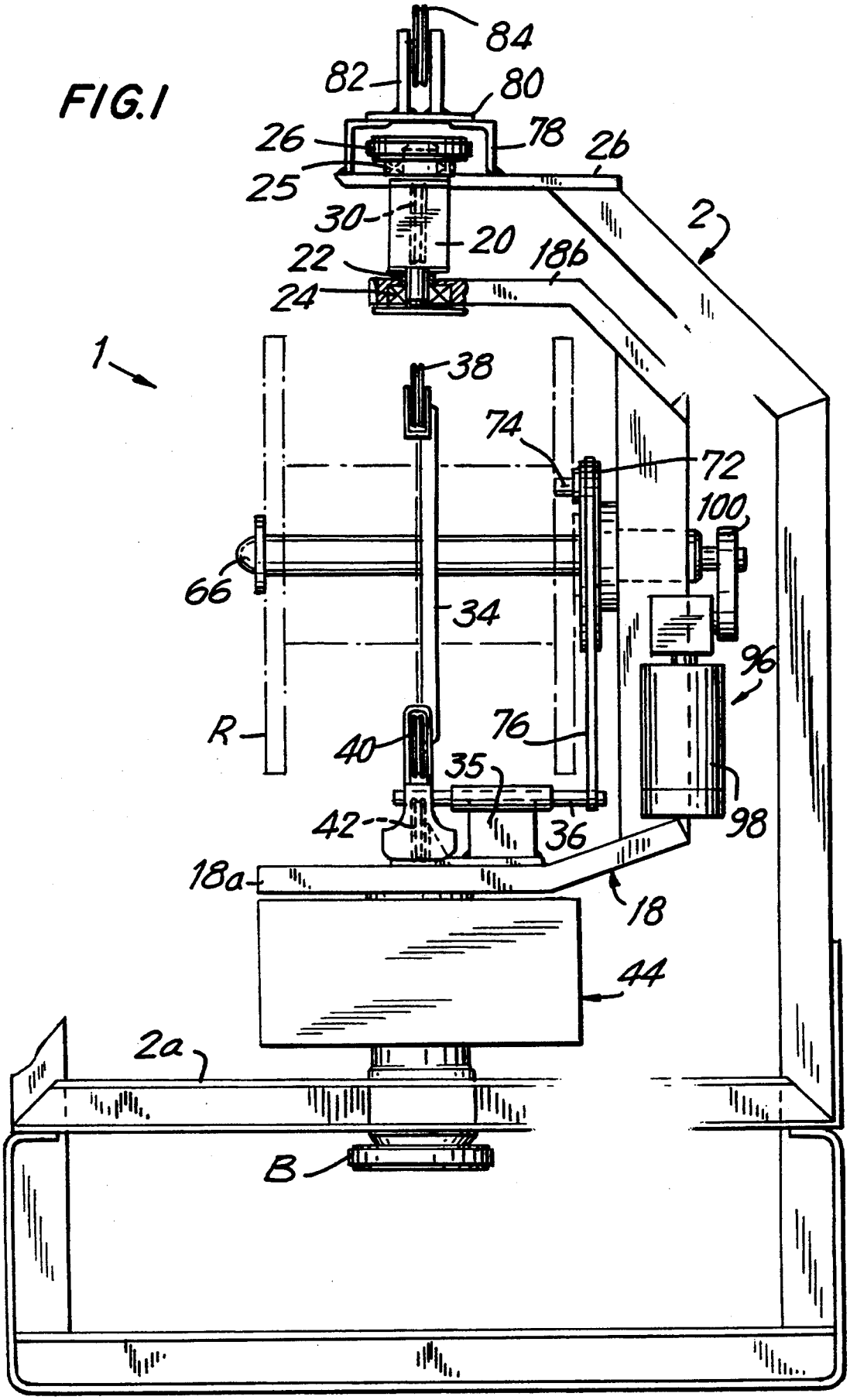
FIG. 1 is a side elevational view of a double twist machine in accordance with the present invention.
Figure 2:
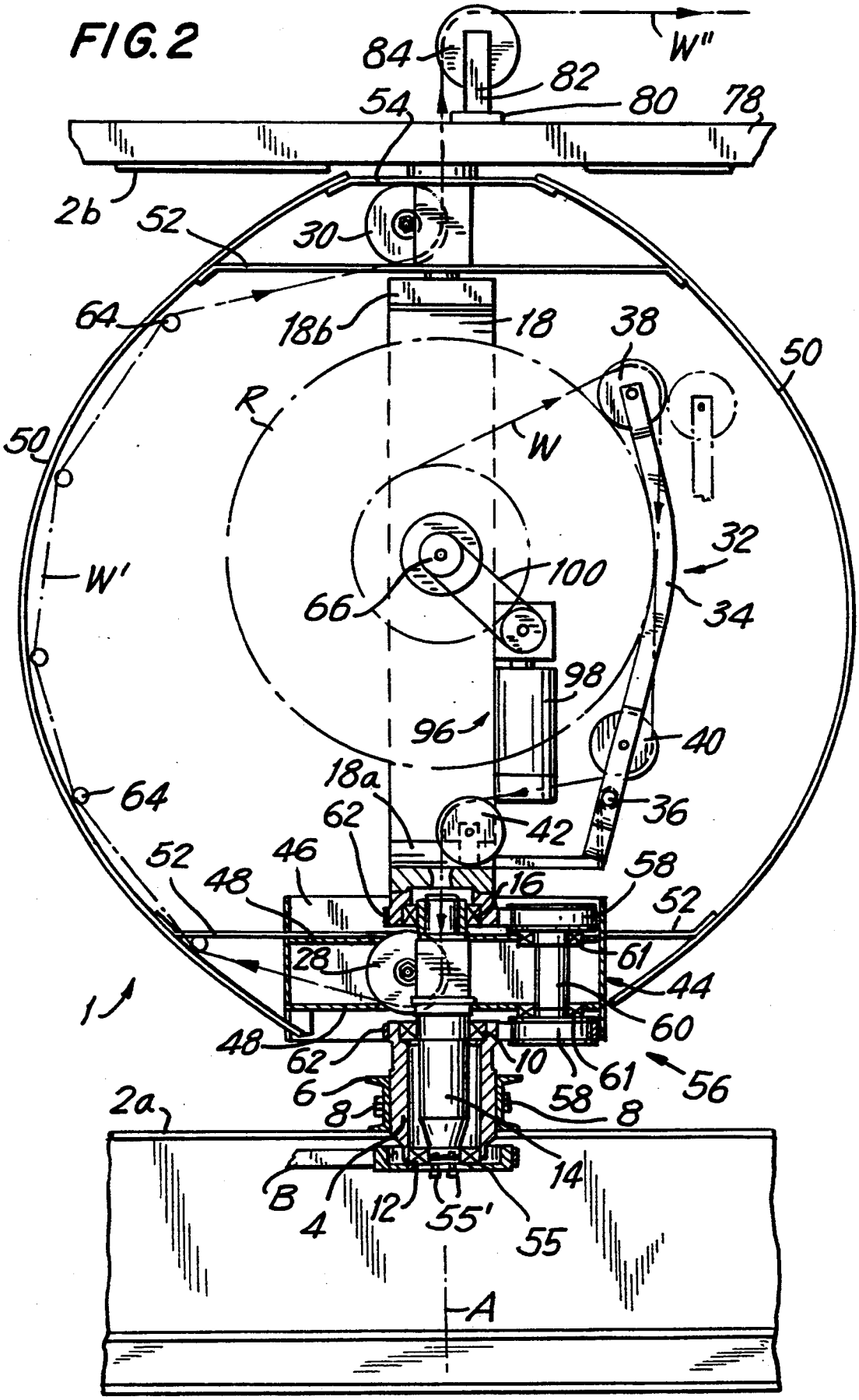
FIG. 2 is a front elevational view of the double twist machine shown in FIG. 1, additionally showing the rotating bows and the structure for rotatably mounting the bows.

Referring now specifically to the drawings, in which identical or similar parts are designated by the same reference numerals throughout, and first referring to FIGS. 1 and 2, a multi-wire single bobbin machine 1 is shown as a double twist machine having its axis of rotation A arranged in a generally vertical direction. The machine 1 includes a main frame and cover assembly 2 which includes a lower support platform 2*a* and an upper support platform 2*b*. Fixed on the lower support platform 2*a* is a cylindrical bearing housing 4 the axis of which coincides with the axis A. The bearing housing 4 is fixedly secured to the lower support platform 2*a* by any suitable or conventional means, such as L or C angle irons or beams 6 which may be fastened to the bearing housing 4 by means of any conventional fasteners 8. Secured at the upper and lower ends of the bearing housing 4 are bearings 10 and 12, respectively. Rotatably supported on the bearings 10, 12 is a vertical shaft 14 which is fitted at the upper end thereof with a bearing 16. A reel cradle 18 is rotatably supported on the bearing 16, at the lower end thereof, and by a rotating support member 20, at the upper end thereof. Referring specifically to FIG. 1, the rotating support member 20 is provided with a downwardly depending pivot shaft 22 which is rotatably received within the bearing 24, the upper end of the rotating support member 20 being rotatably supported by bearing 25 in bearing housing 26 supported on the upper support platform 2*b*. Therefore, the shaft 14 as well as the cradle 18 are rotatably mounted relative to the fixed frame 2.

Mounted on the shaft 14 is a deflecting pulley 28 which rotates with the rotation of the shaft 14. The deflecting pulley 28 is mounted so that a peripheral portion thereof is coincident with the axis A of the machine, as shown. Similarly, a deflecting pulley 30 is provided at the other end of the cradle 18. The pulley 30 is mounted on the rotating support member 20 and similarly has a peripheral portion thereof aligned with the axis A.

In the preferred embodiment, a dancer mechanism which guides the wire off the reel or bobbin R is generally designated by the reference numeral 32. The dancer 32 includes a generally upright dancer arm 34 mounted on support 35 for pivoting rotation about a pivot shaft 36. A first pulley 38 is rotatably supported at the upper end of the dancer arm 34, as viewed in FIGS. 1 and 2, and a further deflecting pulley is mounted on the dancer arm 34, above the pivot shaft 36. A further deflection pulley 42 is mounted on the cradle 18 and is positioned such that a peripheral portion thereof is aligned with the machine axis A as shown.

By way of example, a back drive assembly 44 is provided to fix the position of the cradle 18, acting between the bearing housing 4 and the reel cradle 18. The back drive assembly 44 includes a generally cylindrical rotating drum or housing 46 fixedly attached to the shaft 14 by means of suitable discs or attachment members 48. As best shown in FIG. 2 a pair of bows 50 are arranged in diametrically opposite sides of the axis A and attached at the lower ends thereof by means of braces 52 which secures the bows 50 to the rotating drum or housing 46 and, therefore, to the shaft 14. At the upper ends, as viewed in FIG. 2, the bows are connected to the rotating support member 20 by means of braces 52 and a radial member 54. While two bows have been shown in a balanced configuration, it is also possible to use a single bow balanced by a suitable counterweight, as is well known in the arts, since the second bow typically serves no function other than to balance the working bow which guides the wires.

The lower end of the shaft 14 is secured to any conventional drive means. Any drive means may be used to drive the shaft 14, such as belt and pulley, separate motor drive, gear box, transmission, clutch, gear and chain, etc. Where the drive includes a pulley 55, as shown, it may be attached to the shaft 14 by means of suitable fasteners 55', the drive pulley 55 being coupled to a belt B which is driven by any known drive (not shown). Rotation of the drive pulley 55 by the belt B rotates the shaft 14 and, due to the frictional forces in the bearings, some of the torque is also transmitted to the reel cradle 18. In order to compensate for the torque applied to the cradle 18 and to maintain the cradle stationary relative to the frame 2, notwithstanding the rotation of the shaft 14 and the bows 50, there is provided a suitable epicyclic system 56 which can be fixed in any suitable manner on the rotating drum or housing 46 and provided with timing pulleys 58 rotatably mounted at opposite ends of a shaft 60 by means of bearings 61, the axis of the shaft 60 being substantially parallel to the axis A. The lower timing pulley 58 is coupled to the fixed bearing housing 4 by means of a belt 62, while the upper timing pulley 58 is similarly coupled to the lower portion of the cradle 18 by means of a belt 62. Since the upper and lower pulleys 58 are rigidly connected to each other so that they rotate together, it will be clear that the epicyclic system 56 will maintain the position of the cradle 18 in a fixed position relative to the bearing housing 4 and, therefore, to the frame 2 as long as the cumulative transmission ratio for the epicyclic system is equal to one. While the back drive assembly has been described as a specific way of maintaining the cradle 18 stationary the arrangement shown is not critical and any other known means may be used, such as counterweights, magnets, gear or belt arrangements.

Provided along one of the bows 50 are conventional guides 64, which may be in the nature of eyelets, rolleys, pulleys, etc.

Mounted on the cradle 18 is a spindle 66 arranged to receive a reel or bobbin R. The reel or bobbin R can rotate on the spindle 66 in a conventional manner.

In order to provide tension control, there is advantageously provided a tension control device arranged to pay off wire from the reel R. The specific take off and tension control device used is not critical, although an arrangement of the type disclosed in U.S. Pat. No. 4,423,588 can be used. The pay-off and tension control device includes, in addition to the dancer 32, a brake disk or pulley 72 provided with an off center pin 74 dimensioned and configurated to be received within suitably sized hole within the flange of the reel or bobbin R. A belt or rope 76 extends about the brake disk or pulley 72 and is coupled to the pivot shaft 36. The operation of such a tension control system is described in the aforementioned patent. Any other known tension control and unwinding arrangements may be used. For example, an independent drive may be provided the speed of which may be controlled by the tension in the wires and the speed of rotation of the reel adjusted as required to maintain the tension in the wires at a desired value. With the latter approach, there is no need to use a brake disk or pulley 72.

Provided above the rotating support member 20, aligned with the axis A, are support brackets 78 which are shown as L-beams or angle irons which may be welded to the upper support platform 2*b*. Bridging the two opposing support brackets 78, one on each side of the axis A, is a support plate 80 from which support arms 82 extend upwardly, as viewed in FIGS. 1 and 2, and arranged to rotatably support a deflection pulley 84, a peripheral portion of which is aligned with the axis A, as shown in FIG. 2.

Figure 3:
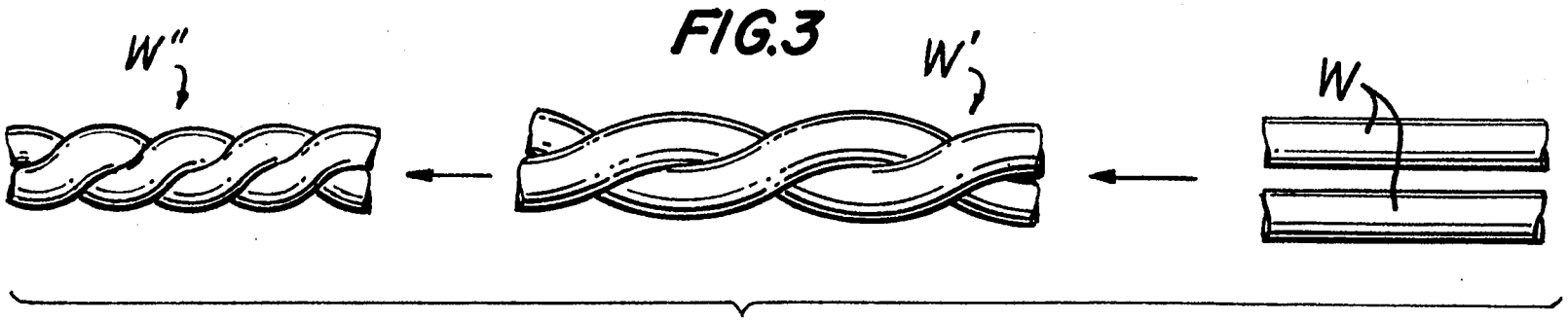
FIG. 3 are three fragmented schematic representations of two wires at different locations within the double twist machine shown in FIG. 2.

The operation of the cradle 18 and the bows 50 is generally known, the machine of the type shown generally being designated as a double twist machine or twinner. An important feature of the present invention is the provision of guide means for simultaneously guiding a set of at least two wires, whether joined or seperate, from the reel R on the cradle 18 prior to twisting of the wires. Thus, referring to FIGS. 2 and 3, the reel R is initially wound with two wires W which are to be twisted about each other. The two wires W are preferably simultaneously extruded on a standard extrusion machine. Alternatively, two separate wires separately extruded are simultaneously wound as a pair onto the reel R prior to placing the reel within the double twist machine or multi-wire single bobbin twinner 1.

Figure 5:
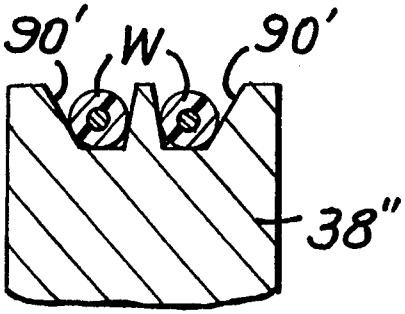
FIG. 5 is similar to FIG. 4, except that instead of one wide groove two separate grooves are provided one for each of the two wires.
Figure 4:
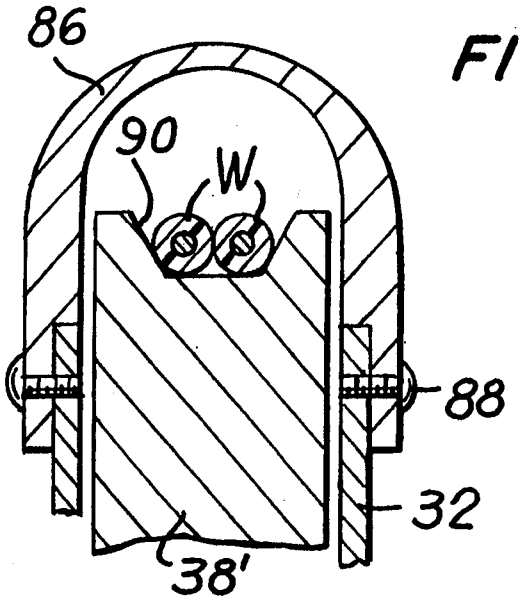
FIG. 4 is an enlarged and fragmented partial view of an initial pulley which guides the wires as they are unwound from the bobbin, having a wide circumferencial groove for accommodating two wires received from the bobbin and further provided with a retaining band.

As is best shown in FIG. 2, the pair of wires W are simultaneously drawn off of the reel or bobbin R, with attendant rotation of the wheel or bobbin R about the spindle 66, and are initially brought into contact with the pulley 38. The pulley 38, forming part of the wire guide system, should be configurated and dimensioned to accommodate and retain the pair of wires was they are drawn off the bobbin or reel. Referring to FIG. 4, for example, the pulley 38′ is shown to have an annular or circumferential groove 90 having a width sufficient to accommodate both wires W. Also shown in FIG. 4 is an optional wire guard or retaining band 86 surrounding the peripheral portion of the pulley 38′ where the wires W first contact the pulley to insure that all of the wires that are simultaneously drawn off are simultaneously guided to and engage the first pulley independently of the relative positions or angles of the wires on the reel. The band 86, which is not critical and may be omitted, can be secured to the ends of the dancer arm 34 by means of any suitable fasteners, such as rivets 88. In FIG. 5, an alternate pulley design 38″ is illustrated in which two separate adjoining annular or circumferential grooves 90′ are provided each dimensioned to securely receive and retain one of the wires W. The grooves 90, 90′ should be sufficiently deep so as to prevent dislodgment of the wires upon application of minor lateral or axial forces acting on the wires. One or both of the pulleys 40, 42 may be similarly be configurated as pulley 38. Beyond the pulley 52, the wires W are twisted and, therefore, advance as a group or single cable and, therefore, the width of the groove 90 is less critical.

The tension in the wires W are maintained at a predetermined desired level by the tension control device 32 and, after the wire engages the pulley 38, it is deflected towards the pulley 40 and subsequently by the pulley 42. Because the pulleys 38, 40 and 42 are all stationary relative to the cradle 18, there is no twisting of the wires about each other up to the pulley 42. However, because the deflection pulley 42 is stationary relative to the rotating pulley 28, a single twist will be imparted to the wires W and the single twisted wires W′ appear at the lower end of the bow 50 as suggested in FIG. 3. The single twisted wires are then guided by the guides 64 to the opposite end of the bow 50 at which time they are again deflected by movable pulley 30 and stationary pulley 84. Again, because of the relative rotation of the pulleys 30, 84, a second twist is imparted and the double twisted wires W″ will have a higher degree of twist as suggested in FIG. 3. It will be understood, therefore, that the single bobbin twinner 1 is capable of producing a twisted pair of insulated wires with only a single bobbin, with attendant smaller size, higher speed and greater efficiency.

Numerous modifications may be made from the described presently preferred embodiment. Thus, while the guides which have been described are primarily suited for receiving a pair of wires from the reel R, it will be clear to those skilled in the art that when "triplets" or "quads" are to be produced, a reel R can be initially wound with three or four wires, respectively, which are simultaneously wound and which can be simultaneously guided along the machine as described to impart double twists to the three or four wires. In theory, of course, any number of wires can be selected and the same procedure applied to twist all the wires about each other.

Additionally, it is possible to modify the presently preferred embodiment by enlarging the cradle 18 to receive two or more reels each of which are pivotally mounted on a cradle, with at least one of the reels being wound with a set of at least two wires which can be simultaneously unwound therefrom. With this type of configuration, each of the reels may include any number of desired wires so that the sum total of all the wires which are guided along the machine is a total of all of the wires which have been wound about the respective reels. In essence, all the wires are simultaneously paid off of all of the reels and bunched together for passage through the double twist machine. Thus, for example, if two bobbins are mounted in the cradle with two wires on each bobbin, the machine can operate as a quadding machine.

A drive for the reel R may be provided, the drive making the machine more versatile since it permits smaller wires to be twinned without placing excessive stresses on the wires or stretching the same. One example of such a drive is shown in FIGS. 1 and 2 and designated by numeral 96. The drive 96 includes a spindle drive motor 98 and belt 100 coupled to the spindle 66. Alternatively, the reel may be fixed so that it does not rotate at all, but the rotating member is in the nature of a fly-off or take-off arm of the type well known in the art which rotates about the reel and flies off the wires off the reel.

Further, while the multi-wire reel has been described in the environment of a double twist machine, it will be understood that such multi-wire reels may also be used in single twist machines. The method would be similar except, of course, only a single twist would be imparted to all the wires that are simultaneoiusly guided from the reel or reels in the machine. Double twist machines, however, are generally more suitable for the production of telephone cables since the machines are much faster and more efficient.

Figure 6:
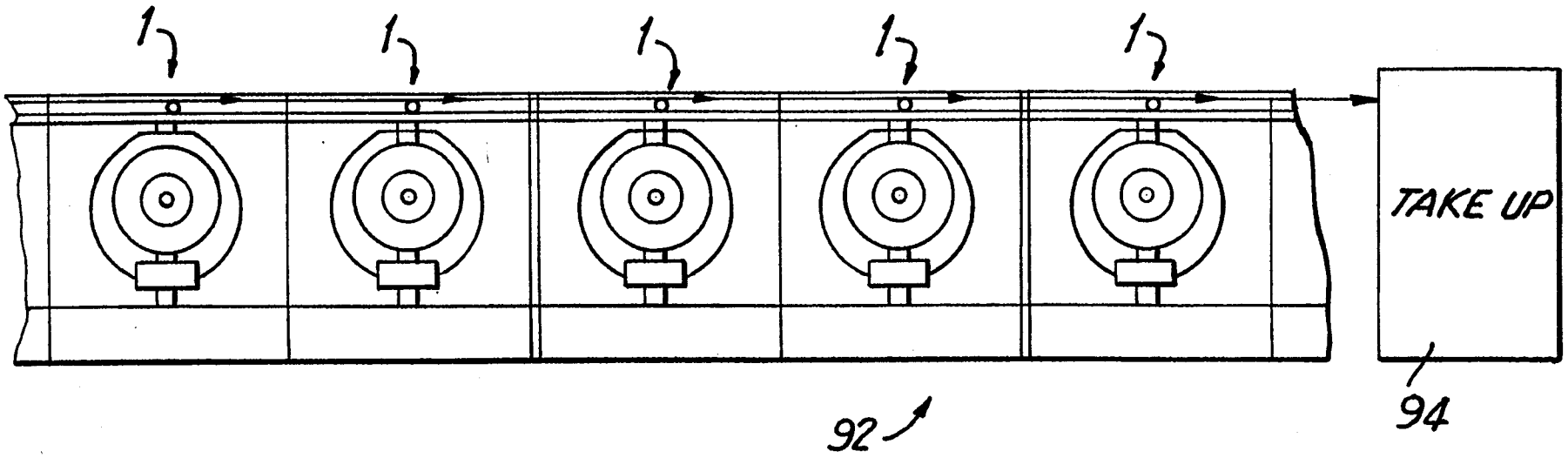
FIG. 6 is a schematic representation of a bank of twisting machines of the type, for example, shown in FIGS. 1 and 2 arranged in tandem, all feeding a common take-up.

It would be readily evident to those skilled in the art that the apparatus is extremely flexible and can produce a wide variety of cables. This versatility is additionally enhanced considering that a bank of any number of multi-wire twinners 1 can be arranged in tandem, as shown in FIG. 6, each machine or twinner 1 producing its own desired cable component or element consisting of n-wires double twisted about each other. The sum total of all of these cable components or elements can then be taken up in any known or desired take-up device 94 which, in essence, assembles the cable components or elements into a desired telephone cable. Any take-up machine may be used, such as stationary or rotating, single or double twist machines, capstan, extrusion lines, etc.

The method of the present invention entails simultaneously unwinding a set of at least two wires wound on a single reel in a double twist machine or the like, guiding all the wires through the machine and imparting a double twist to all the wires of the set of wires. In this manner, a set of twisted wires may be produced with as few as a single reel. As suggested, any number of separate wires can be unwound from a reel to thereby twist a plurality of such wires about each other from a single reel. Two or more wires can be extruded from an extruder and simultaneously wound on a reel, and the reel loaded into the double twist machine or the like used for twisting the wires about each other. The present invention also contemplates repeating the aforementioned method in a bank of double twist machines arranged in tandem to each other and taking up the twisted pairs from a plurality of double twist machines and twisting them to form one composite cable.

The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

I claim:

1. Apparatus for making telephone cables with multi-wire reels, comprising a frame; rotating means arranged in a substantially balanced configuration for rotation about a first axis relative to said frame, said rotating means including at least one elongate member in the form of a bow offset from said axis which defines an envelope as said bow rotates about said axis; a cradle mounted for rotation about said first axis and dimensioned and configured to be contained within said envelope and adapted to receive as few as a single reel for rotation about a second axis substantially normal to said first axis mounted within said cradle and at least one reel of which is wound with a set of at least two wires which is simultaneously unwound from said as few as a single reel; cradle fixing means for maintaining the position of said cradle substantially fixed about said first axis relative to said frame during rotation of said rotating means; guide means for simultaneously guiding the set of at least two wires from said at least one reel on said stationary cradle to said rotating means and thereafter to said stationary frame thereby imparting at least one twist to the set of at least two wires unwound from the reel and a tension control device within said envelope for each said at least one reel to maintain the tension in all the wires in said set of at least two wires at a substantially constant predetermined value.

2. Apparatus as defined in claim 1, wherein said at least one reel is rotatably mounted on said cradle, and the set of at least two wires is unwound by pulling the wires off said at least one reel with attendant rotation of said at least reel.

3. Apparatus as defined in claim 1, further comprising drive means for driving said rotating means.

4. Apparatus for making telephone cables with multi-wire reels as defined in claim 1, wherein said rotating means comprises at least one bow mounted for rotation relative to said frame and cradle about said axis.

5. Apparatus for making telephone cables with multi-wire reels as defined in claim 1, wherein said guide means includes a first pulley to which the set of at least two wires is guided, said first pulley having a circumferential groove dimensioned to receive the set of at least two wires.

6. Apparatus for making telephone cables with multi-wire reels as defined in claim 1, wherein said guide means includes a first pulley to which the set of at least two wires is guided, said first pulley being provided with a plurality of adjacent circumferential grooves each for receiving another of the set of at least two wires.

7. Apparatus for making telephone cables with multi-wire reels as defined in claim 1, wherein said cradle is adapted receive at least two reels pivotally mounted on said cradle, at least one of the reels being wound with a set of at least two wires which can be simultaneously unwound therefrom, said guide means simultaneously guiding all the wires from all the reels on said stationary cradle to one end of a movable bow and thence to the other end thereof and to said stationary frame thereby imparting a double twist to the plurality of wires that are simultaneously unwound from the two reels.

8. Apparatus for making telephone cables with multi-wire reels as defined in claim 7, whereby a bank of multi-wire reel machines are arranged in tandem; and further comprising take up means for receiving and winding the plurality of sets of double twisted wires generated by each of the machines.

9. Apparatus for making telephone cables with multi-wire reels as defined in claim 1, whereby a bank of multi-wire reel machines are arranged in tandem; and further comprising take up means for receiving and winding the plurality of sets of twisted wires generated by each of the machines.

10. Apparatus for making telephone cables with multi-wire reels as defined in claim 1, further comprising drive means for rotating the reel at a speed which corresponds to the desired speed of take-off of the wires from the reel.

11. Apparatus for making telephone cables with multi-wire reels, comprising a frame; rotating means arranged for rotation about a first axis relative to said frame; a cradle mounted for rotation about said first axis and adapted to receive as few as a single reel for rotation about a second axis substantially normal to said first axis mounted within said cradle and at least one reel of which is wound with a set of at least two wires which is simultaneously unwound from said as few as a single reel; cradle fixing means for maintaining the position of said cradle substantially fixed about said first axis relative to said frame during rotation of said rotating means; guide means for simultaneously guiding the set of at least two wires from said at least one reel on said stationary cradle to said rotating means and thereafter to said stationary frame; and single tension control means for each said at least one reel to maintain the tension in all the wires in said set of at least two wires at a substantially constant predetermined value, thereby imparting a twist to a set of at least two wires unwound from said as few as a single reel.

12. Apparatus for making telephone cables with multi-wire reels as defined in claim 11, wherein said guide means comprises bows of a double twist machine.

13. Apparatus for making telephone cables with multi-wire reels as defined in claim 11, wherein said guide means comprises an arm of a single twist machine.

14. Method of making telephone cables with multi-wire reels, comprising the steps of rotating at least one elongate member in the form of a bow offset from a first axis for defining an envelope as said bow rotates about said first axis; mounting a cradle for rotation about said first axis within said envelope and receiving as few as a single reel within said cradle for rotation about a second axis substantially normal to said first axis; simultaneously unwinding from said as few as a single reel a set of at least two wires; fixing said cradle for maintaining the position of said cradle substantially fixed about said first axis relative to a frame during rotation; simultaneously guiding the set of at least two wires from said at least one reel on the stationary cradle to said bow and thereafter to said frame thereby imparting at least one twist to the set of at least two wires unwound from the reel; and maintaining the tension in all the wires in said set of at least two wires at a substantially constant predetermined value.

15. A method of twisting at least two wires about each other as defined in claim 14, further comprising the step of repeating the method in a plurality of locations arranged in tandem to each other, and taking up the twisted wires to form a composite cable.

16. A method of twisting at least two wires about each other as defined in claim 14, wherein said twist imparting step imparts a single twist.

17. A method of twisting at least two wires about each other as defined in claim 14, wherein said twist imparting step imparts a double twist.

* * * * *